US012768127B2

(12) United States Patent
Brown

(10) Patent No.: US 12,768,127 B2
(45) Date of Patent: Oct. 20, 2026

(54) WORKING ARM MEMBER WITH UNITARY PLATE ARRANGED AS U-CHANNEL

(71) Applicant: J.C. BAMFORD EXCAVATORS LIMITED, Uttoxeter (GB)

(72) Inventor: Toby Leonard Brown, Uttoxeter (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 252 days.

(21) Appl. No.: 18/607,415

(22) Filed: Mar. 15, 2024

(65) Prior Publication Data

US 2024/0309602 A1 Sep. 19, 2024

(30) Foreign Application Priority Data

Mar. 16, 2023 (GB) ..... 2303880

(51) Int. Cl.
*E02F 3/38* (2006.01)

(52) U.S. Cl.
CPC ..... *E02F 3/38* (2013.01)

(58) Field of Classification Search
CPC ..... E02F 3/38
USPC ..... 414/722
See application file for complete search history.

(56) References Cited

U.S. PATENT DOCUMENTS 5,316,709 A 5/1994 Ko et al.
2001/0038789 A1* 11/2001 Espanel ..... E02F 3/38 414/680
2008/0187427 A1* 8/2008 Durney ..... E02F 3/38 414/722
2019/0316315 A1 10/2019 Hallale et al.
2019/0316316 A1* 10/2019 Hallale ..... E02F 3/382

FOREIGN PATENT DOCUMENTS

EP 3553231 10/2019

OTHER PUBLICATIONS

Extended European Search Report issued in EP 24163444.3, dated Aug. 19, 2024.
Search Report for GB 2303880.5, dated Sep. 8, 2023.

* cited by examiner

*Primary Examiner* — Gerald McClain
(74) *Attorney, Agent, or Firm* — MARSHALL, GERSTEIN & BORUN LLP

(57) ABSTRACT

A structural member of a working arm of a working machine includes a first end and a second end having an elongate body extending therebetween. The body includes first and second opposing panels and third and fourth opposing panels, the third panel extending between a first edge of the first and second panels and the fourth panel extending between a second edge of the first and second panels to provide a box section. The third and fourth panels include at least one pivot mount for connecting the working arm member to a further working arm member or the working machine, and, at least one actuator mount for connecting a working actuator, the working actuator being operable to move the working arm member. The first, second, third and fourth panels are structurally bonded together by an adhesive.

19 Claims, 3 Drawing Sheets

WORKING ARM MEMBER WITH UNITARY PLATE ARRANGED AS U-CHANNEL

FIELD

The present invention relates to a working arm member for a working machine, a working machine incorporating such a working arm member, and a method of manufacture.

BACKGROUND

Working machines are commonplace in many agricultural, construction and industrial settings and used to excavate, transport or otherwise handle materials and loads of various types. A subset of working machines, for example, telehandlers, loaders, backhoe loaders and excavators, include working arms which carry working implements of various types. Typical working implements for working arms may include an excavating bucket, a pair of forks or a loading shovel, amongst many others.

Working arms come in various configurations which are suited to specific tasks. Typically, a working arm for performing excavation will include at least a boom and a dipper. The boom is pivotably connected to the body of the working machine with the dipper extending at a distal end therefrom via a second pivotable connection. The working implement is pivotably attached to the distal end of the dipper via a third pivotable connection. The boom, dipper and working implement are each typically actuated about the respective pivotable connections by hydraulic cylinders.

Other working arms, for example, those for a telehandler, may include a unitary or telescopic boom which is pivotably connected to the body of the machine, with a working implement attached to the distal end thereof. Some working machines, such as a loader or skid steer, may include fixed length working arms and/or multiple working arms which work in unison.

Working arms are conventionally constructed by assembling and welding a number of prefabricated plates together, typically to provide a box section. Reinforcing plates, also referred to as patch plates, or internal webs or other members may be added to the working arm to provide local reinforcement where required. The pivotable connections and cylinder mounts are provided by appropriately located bosses and/or bushes.

Welded plate construction provides a relatively simple and cost effective way of manufacturing working arms. However, welding plates can induce stress which can ultimately leads to fatigue and longevity issues in working arms. Overcoming weld related stress issues can require carefully controlled manufacturing processes and design trade-offs which are less than ideal.

The present invention provides a working arm and a method of manufacturing a working arm which seeks to reduce problems in the prior art, in particular in relation to welded plate working arms.

SUMMARY

The present invention provides a working arm member according to the appended claims.

The present disclosure provides a working arm member of a working arm for a working machine comprising a plurality of structural panels are bonded together using a structural adhesive. The plurality of panels may be arranged to provide a box section. The box section may comprise the main load bearing element of the working arm member. That is, the structurally bonded panels may provide the main structural element of the member rather than a bracket, flange or other ancillary component or attachment.

The member may be a structural member configured to be the main load bearing element of the working arm.

The use of structural adhesive for bonding the structural panels of the main spar(s) of a working arm is advantageous for a working machine as it removes the need for welding. The avoidance of welding helps reduce stress and performance fatigue in the working arm. It further reduces mass and helps reduce issues with corrosion. Further, the aesthetics of a bonded working arm may be improved as it avoids the need for a weld bead.

Further, the use of structural adhesives allows for the use of different materials in the structural elements of the structural member. In a conventional welded plate working arm member, the materials used for each panel are typically of the same type (composition) with the thickness being increased in the members subjected to a higher load. This is, at least in part, due to the strength rating of the welded components being limited to the weld, rather than the steel used. The use of structurally adhered components removes the limiting factor of the weld and allows the different strength materials to be used. As such, the components which experience a higher load which ordinarily be thicker steel having the same strength, may be made thinner and therefore lighter using a stronger steel. Components which experience a lower level of load in use may comprise a lower strength steel to help reduce cost. In some embodiments, the thickness of the various structural plates may be common across the construction of the Further, the use of structural adhesives may provide efficiencies in manufacturing including consumables, energy and labor costs.

The present disclosure provides a structural member of a working arm of a working machine. The structural member may comprise: a first end and a second end having an elongate body extending therebetween. The body may comprise first and second opposing panels and third and fourth opposing panels. The third panel may extend between a first edge of the first and second panels and the fourth panel may extend between a second edge of the first and second panels. The arrangement of the first, second, third and fourth panels may provide a box section.

The third and fourth panels may comprise: at least one pivot mount for connecting the working arm member to a further working arm member or the working machine. The third and fourth panel may comprise at least one actuator mount for connecting a working actuator. The working actuator may be operable to move the working arm member relative to the working machine or another working arm member of the working arm.

The first, second, third and fourth panels may be structurally bonded together by an adhesive. The adhesive may comprise an epoxy resin or other conventional structural adhesive. The epoxy resin may be a single or two part resin and may be thermally or chemically activated.

The first panel and second panel may comprise plate members having a base wall and sidewalls extending therefrom. The base wall and sidewalls may form a U-shaped channel.

The first and second panels may oppose one another such that the base walls provide opposing external walls of the box section/structural member with the side walls extending towards one another. The third and fourth panels may be structurally bonded to the sidewalls. The side walls may provide outward facing planar bond surfaces for bonding to inward/internal faces of the third and fourth panels. The third and fourth panels may be referred to as side panels of the working arm member.

The third and fourth panels may be bonded along the full length of the first and second panels. The side walls may extend for the full length of the first and second panels.

The third and fourth panels may comprise at least one aperture for receiving the pivot pin of a pivot mount or actuator mount. The third and fourth panels may comprise arms which extend longitudinally and transversely from the first and second panels. Thus, the third and fourth panels may extend longitudinally and laterally beyond the first and second panels. The arms may comprise the at least one aperture for the pivot mounts and actuator mounts. The arms may be provided by fifth and sixth plates which are attached to the third and fourth plates via an adhesive bond. The arms may be an integral part, i.e. a continuation of, the third and fourth panels.

The term "panel" used herein may refer to a planar member. The planar member may be bent prior to assembly, e.g. to form the u-channel of the first and second panels, or may be used as a planar member.

The side walls of the first and second panels may contact one another at an interface at the first end and/or second end of the main body. The interface may be provided along the full length of the first and second panel. Alternatively, the opposing side walls of the first and second panels may comprise an extended portion, the end edge of which provides the interface. There may be a first extended portion at a first end and a second extended portion at the second end. The first and second extended portions may be separated by a mid-portion having a shallower depth than the first and second extended portions.

The side walls may comprise at least one further aperture which corresponds to the aperture in the third and fourth panels. The further aperture may be coaxially aligned with the aperture in the third and fourth panels. The further aperture may be larger than the aperture.

The further aperture may be provided across the interface between the opposing sidewalls at the first end or second end. Each of the sidewalls of the first and second panels may comprise a semi-circular cut-out which combines with a corresponding semi-circular cut of the opposing panel, the semi-circular cut-outs combining to provide the further aperture. The further aperture may be configured to receive a bushing. The bushing may be compression fitted within the further aperture. The first and second panel sidewalls may comprise a full further aperture. That is, the circumferential edge of the further aperture may be within one of the first or second panels.

The third and second panels may be longer than the first and second panels so as to cantilever from the body.

The third and fourth panels may correspond to one another. That is, the third and fourth panels may comprise a common shape and dimensions.

The first and second plates may be asymmetrically arranged with respect to a central plane which extends therebetween. Hence, the side walls of the first panel may be shallower in depth than those of the second panel, for example.

The side walls of the first and second panels may comprise one or more weight reducing apertures. The apertures may be elongate and extend along the length of the side walls. The apertures may allow the span of the sidewall and the bonding surface to be increased without increasing the weight of the working arm member. The mid-portion may comprise the apertures. The apertures may be longitudinally aligned and separated by bridge portions. In other words, the side walls of the first and second panels may comprise parallel wall portions which extend longitudinally. The first wall portion may be located proximal to the base wall of the first and second panels. The second wall portion may be located distal the base wall. The first and second wall portions may be connected by a bridge which extends therebetween.

The member may comprise at least one reinforcement member located around the at least one actuator mount and/or the at least one pivot mount. The reinforcement member may comprise a local thickening of the third or fourth panel. The reinforcement member may comprise a further plate which is bonded to third or fourth panel using a structural adhesive. The reinforcement member may comprise an aperture for receiving the pivot pin of the actuator mount or pivot mount. The reinforcement member may be located on an inward facing surface or an external facing surface of the third or fourth panels. The reinforcement member may be bonded using adhesive.

The member may further comprise a plurality of pivot mounts and actuator mounts, wherein the reinforcement member extends between the plurality of pivot mounts and actuator mounts. The reinforcement member may extend around a peripheral edge of the third and/or fourth panels.

The working arm member may be any one of a boom, a dipper (which may be referred to as stick). The working arm may be a working arm of an excavating machine. The excavator may be a slewing excavator (tracked or wheeled) or may be a backhoe, for example. In some embodiments, the working arm may comprises a boom or a pivoting boom as may be found in a telehandler or loader. The working arm may be that of a loader.

The panels may comprise steel plates. The steel plates may comprise a higher strength plate steel and a lower strength plate steel. The steel used for the third and fourth panels may comprise the higher strength steel. The steel used for the first and second plates may comprise the lower strength steel. The higher and lower strength steels may comprise different compositions.

The present disclosure may comprise a working machine comprising a working arm, the working arm comprising at least one working arm member according to the present disclosure.

The skilled person will appreciate that except where mutually exclusive, a feature described in relation to any one of the aspects, embodiments or examples described herein may be applied mutatis mutandis to any other aspect, embodiment or example. Furthermore, except where mutually exclusive, any feature described herein may be applied to any aspect and/or combined with any other feature described herein.

BRIEF DESCRIPTION OF DRAWINGS

Embodiments will now be described by way of example only with reference to the accompanying figures, in which.

DETAILED DESCRIPTION

In the following detailed description, numerous specific details are set forth in order to provide a thorough understanding of various embodiments and the inventive concept. However, those skilled in the art will understand that: the present invention may be practiced without these specific details or with known equivalents of these specific details; that the present invention is not limited to the described embodiments; and, that the present invention may be practiced in a variety of alternative embodiments. It will also be appreciated that well known methods, procedures, components, and systems may have not been described in detail.

Figure 1:
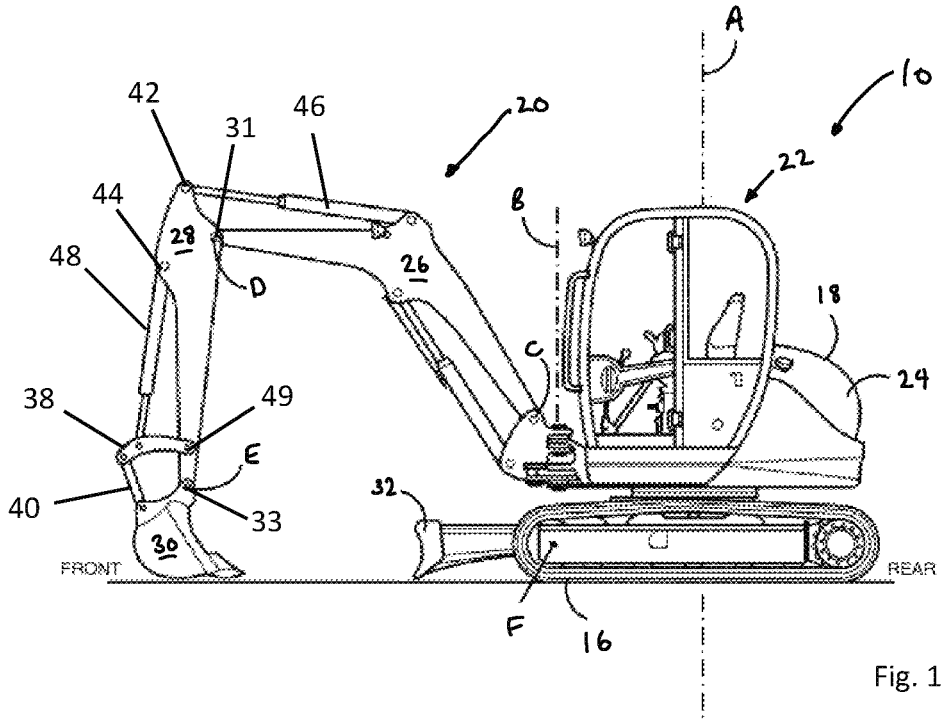
FIG. 1 shows a side view of a working machine.
Figure 2:
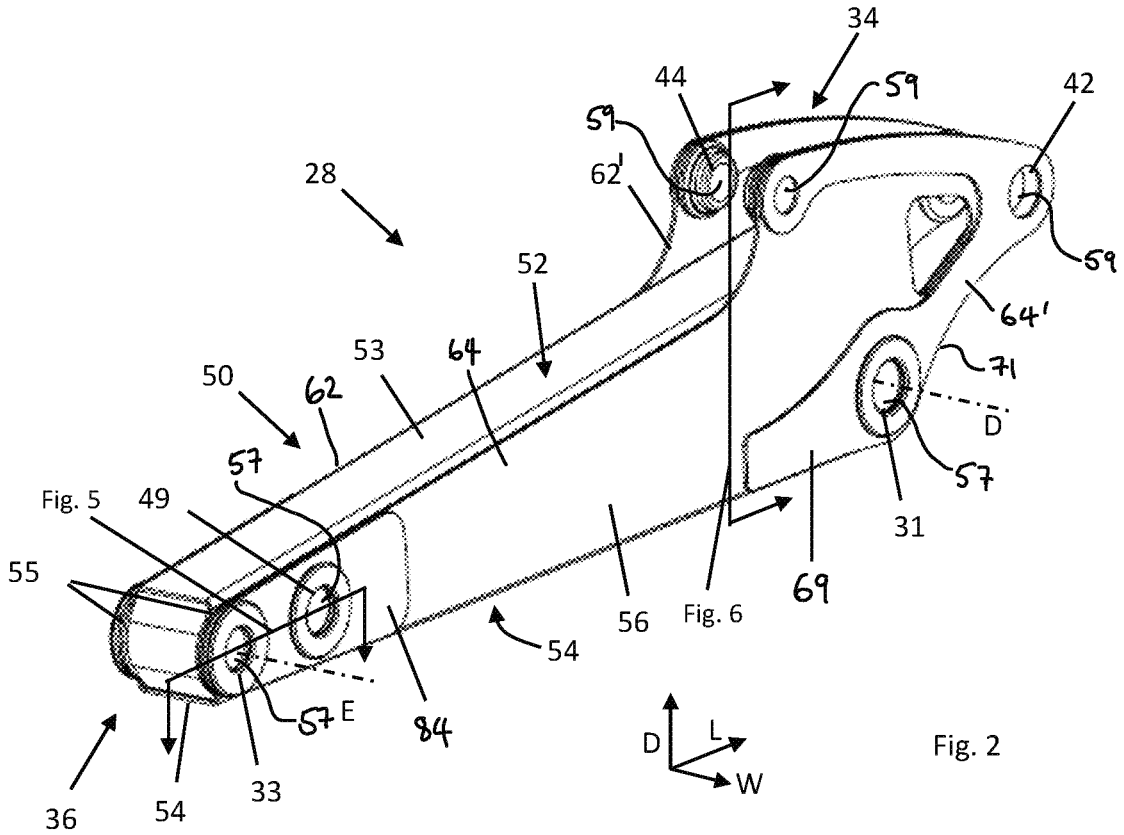
FIG. 2 shows a perspective view of a dipper according to an embodiment of the present disclosure.

With reference to FIGS. 1 and 2 there is shown a working machine 10, in the form of a mini excavator. The mini excavator includes a chassis 12, a track assembly 16, a body 18 and a working arm 20. The body is rotatable about a generally vertical slewing axis A and includes a cab 22 and a prime mover in the form of an engine (not shown but positioned under engine cover 24).

The working arm 20 includes structural members which provide the main load bearing elements of the working arm. In the illustrated example, the structural members comprising a boom 26 and a dipper 28 which are used to manipulate a working implement in the form of an excavating bucket 30.

The boom 26 is rotatable about a generally vertical axis B relative to the body and about a generally horizontal axis C. The dipper arm 28 is rotatable about a generally horizontal axis D relative to the boom 26. The bucket 30 is rotatable about a generally horizontal axis E relative to the dipper 28. On the front of the chassis is a blade 32 having a lower front edge. The blade 32 is pivotable about a generally horizontal axis F.

FIG. 2 shows the dipper 28 in isolation of the boom 26 and bucket 30. For the purpose of this description, the dipper 28 can be considered to have length L, depth D and width W as shown by the axes in FIG. 2. The dipper 28 comprises body 50 having a first or proximal end 34 which attaches to the boom 26 via a pivot mount 31 which defines pivot axis D, and a second distal end 36 which attaches to the bucket 30 via pivot mount 33 which defines pivot axis E. A further pivot mount 49 is provided for a tipping link 38 which spans between the dipper 28 and bucket link(s) 40 for guiding the movement of the bucket 30 under the influence of bucket cylinder 48. Actuator mounts 42 and 44 are provided for the dipper cylinder 46 and bucket cylinder 48 respectively. It will be appreciated that the bucket cylinder 48 and bucket links 40 may be generically referred to as a working implement cylinder and a working implement links 40 in other embodiments.

The cylinders 46, 48 are conventional hydraulic cylinders which may be mounted in any suitable way. In the illustrated embodiment the cylinders are connected to a source of hydraulic fluid and are operable to extend and contract in accordance with an operator demand. It will be appreciated that the presence, position and size of the various pivot mounts and actuator mounts may vary across embodiments and according the functional requirements of the working arm (e.g. excavator, loader, handler).

Each of the pivot mounts 31, 33, 49 and actuator mounts 42, 44 may comprise a bearing element(s) to rotatably receive a pivot pin (not shown) such as a bushing. Opposing faces of relatively rotating components, such as the clevis mounts of the cylinders 46, 48 and corresponding actuator mounts 42, 44, or the dipper 28 and boom 26 connections, may be provided with planar bearing elements such as shim bearings. The bearing elements of the illustrated embodiment are described in further detail in connection with FIGS. 5 and 6 below.

The dipper 28 broadly comprises a main body 50 having first and second opposing panels 52, 54 with a third panel 62 extending between a first edge of the first and second panels 52, 54 and the fourth panel 64 extending between a second edge of the first and second panels 52, 54. The arrangement of the panels 52, 54, 62, 64 provides a box section/box beam having a generally hollow interior. In the illustrated embodiment the external walls provided by the panels 52, 54, 62, 64 are arranged in an orthogonal relation and are planar. However, these are not limitations and the external walls may be angled, curved or faceted in various embodiments. As can be seen, the depth of the main body 50 may taper along its length having a shallower depth at the second end. The width may be constant.

The first and second panels 52, 54 are shown as being provided by upper and lower members as viewed in FIG. 2. In use, the first panel 52 may be that which faces away from the machine body 18 when the dipper 28 is in an upright position, and the second panel 54 may be that which faces the machine body 18. The third and fourth panels 62, 64 may provide the side members of the dipper 28 and may face laterally outwards from the machine 10 when the boom 26 is aligned with the fore-aft axis of the machine 10. The terms first, second, third and fourth panels 52, 54, 62, 64 are used nominally herein and may be replaced with other or conventional terms in accordance with a particular application.

The third and fourth panels 62, 64 may comprise the pivot mounts 31, 33 for connecting the working arm member 28 to a further working arm member 26, working implement 30 or the working machine 10; and, the actuator mounts 42, 44 for connecting to the cylinders 46, 48. More specifically, the third and fourth panels 62, 64 comprise arms 62' and 64' which extend therefrom to provide suitable supports for the dipper and bucket cylinder mounts 42, 44. The arms 62', 64' may take the form of plates which are coplanar with the side walls and an extension of the third and fourth panels beyond the extent of the first and second panels 52, 54. The arms 62', 64' and third and fourth panels 62, 64 may be comprises a unitary structure, that is, a continuous homogeneous plate.

In a conventional dipper the main body 50 may be constructed by welding together plates which provide the walls of the box beam. In the illustrated embodiment, the main body 50 is constructed using structural adhesive. As such, the first, second, third and fourth panels 52, 54, 62, 64 are held together predominantly, if not exclusively, by structural adhesive. In other words, the main structural panels 52, 54, 62, 64 of the dipper 28 are bonded together without the use of welding or other means of direct attachment.

Structural adhesives are known in the art and may be considered to be any high-strength adhesive which is used to bond load bearing structures. Structural adhesives are used in various industries such as aerospace where they are used for metal-metal, metal-composite and composite-composite bonding, for example. The use of structural adhesives in working machines such as construction equipment has been known for attaching ancillary structures such as brackets. However, there is no know use of structural adhesives to make the principal load bearing structures of the working arm 20 of a working machine such as an excavator.

The structural adhesives of interest for the present disclosure may be any suitable and may comprise, in particular, an epoxy resin. The epoxy resin may comprise a one or two part adhesive which may be chemically or thermally cured. Other suitable non-epoxy resin based adhesives may be known. Examples of suitable adhesive may include: Teroson EP 5089 or Teroson EP 5055 produced by Henkel; Scotch Weld DP490 produced by 3M; or Kisling 7410 produced by Kisling.

Figure 4:
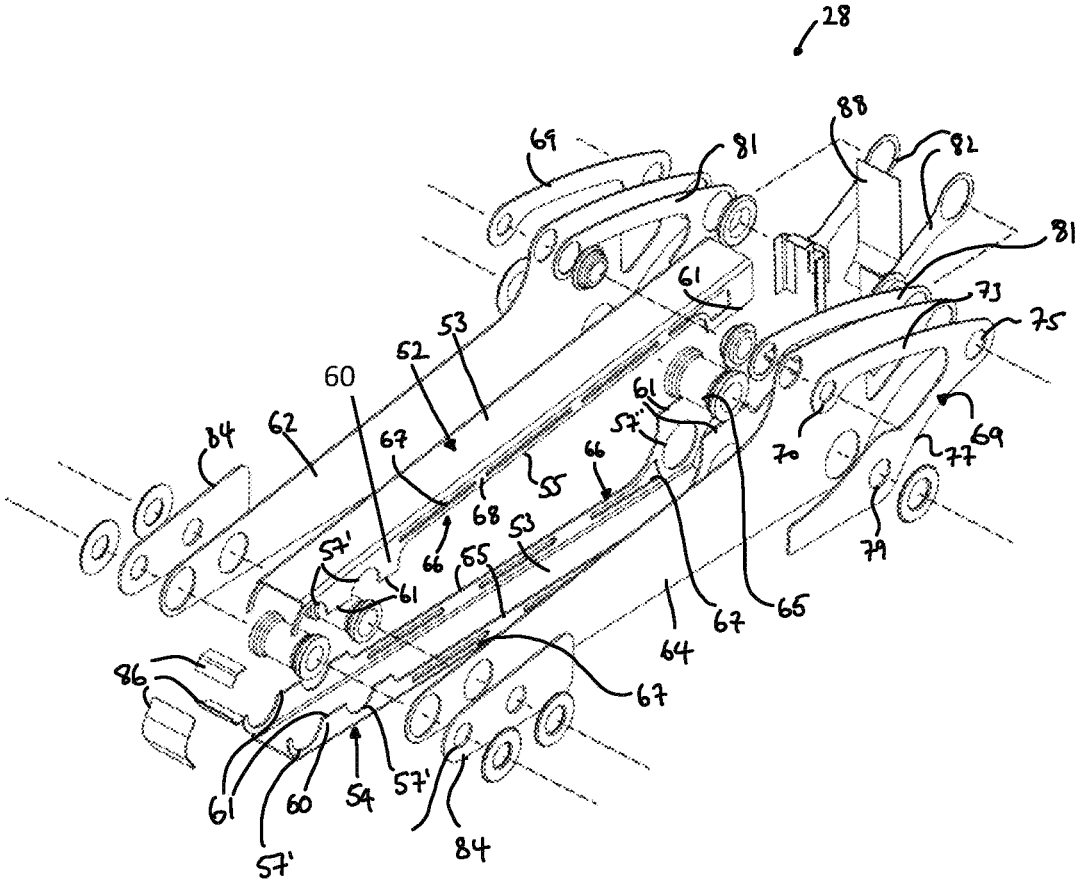
FIG. 4 shows an exploded view of the dipper of FIG. 2.

With additional reference to FIG. 4, in the illustrated embodiment, the first and second panels 52, 54 each comprise edges which are contacted and bonded by the third and fourth panels 62, 64. In order to provide the edges in the correct orientation and with a suitable surface area for bonding, the first and second panels 52, 54 each comprise an elongate U-section beam, which may be referred to as a u-pressing due to the way it is formed, which extends generally along the longitudinal axis of the dipper 28 between the first and second ends 34, 36.

Each U-section beam comprises a base wall 53 with side walls 55 extending therefrom. The U-section channel may be formed from a single unitary plate which is bent, e.g. pressed, into the required shape. The first and second panels 52, 54 are provided in an opposing relation to one another with the base walls 53 outermost and the side walls 55 extending inwardly towards each other to provide an outward facing bonding surface to which the third and fourth panels 62, 64 may be adhered. Thus, each of the first and second panels 52, 54 comprise first and second edges between which the side panels 62 64 extend. The side walls 55 may abut one another at the first and second ends 34, 36 (and/or at a mid-region) to add strength and to ensure the base walls 53 are correctly positioned relative to one another.

In the illustrated embodiment, the base walls 53 of the first and second panels 52, 54 provide the outmost external walls of the dipper 28 on the upper and lower surfaces (as shown) with the side walls 55 extending inwardly, typically perpendicularly, to provide an outwardly facing bonding surface for the side members 56. The side walls 55 and side members may comprise pivot mount apertures 57 and/or actuator mounts 59.

The junction between the opposing side walls 55 of the first and second panels 52, 54 is provided between end edges 61 of an extended portion 60 of the respective sidewalls 55. The extended portions 60 may combine to provide a full side wall which extends between the base walls 53 of the first and second panels 52, 54.

The respective extended portions 60 of the side walls 55 may be separated by a shallower mid-portion 66 of side wall having less depth. Providing a full depth side wall 55 at the ends of the main body 50 and a shallower mid-portion allows the structural member 28 to be strengthened at the load bearing portions, i.e. at the first and second ends 34, 36 in the illustrated embodiment, whilst reducing the weight of the component by providing a shallower mid-portion 66.

The end edges 61 of the extended portions 60 may be bonded to one another using a structural adhesive.

At the second end 36, the interface between the sidewalls 55 includes corresponding cut-outs 57' which combine to provide an aperture 57 for receiving pivot pins/bushings 65 of the bucket and tipping link pivot mounts 33, 49. The cut outs 57' in the illustrated embodiment are semi-circular such that the bushing 65 may be received snugly therein as the first and second panels 52, 54 are brought together. The interface is provided at or around the mid-line of the main body 50 at the second end 36.

At the first end 32, the interface is provided by an unbroken straight line end edge 61 without cut outs. The boom pivot mount 31 comprises a bush 65 which is located within an aperture 57" provided in the side wall of the second panel 54. The aperture 57" is provided entirely within the second panel side wall 55 in order to provide increased support required due to the increased and varying load profile which may be experienced at the first end in typical excavator use. In some embodiments, the first end aperture 57" may be provided in a similar manner to aperture 57' provided at the second end, that is using cut outs. The bush 65 may be fitted by flaring side walls 55 apart or as a two part tube which is joined after each half being fitted axially through the opposing apertures 57" in each side wall 55.

The mid-portion 66 of first panel 52 sidewall 55 extends longitudinally between the respective extended portions 60 and inwardly towards the opposing sidewall of the second panel 54. The depth of the mid-portion 66 is less than the extended portions 60 but sufficient to provide a suitable surface for bonding the side members 62, 64. As can be seen, the depth of the sidewall 55 may be constant along its length but this may vary in other embodiments depending on the required bond strength along the interface. The transition between the mid-portion 66 and the respective extended portions 60 may be provided by an internally radiused shoulder.

The specific depths of the mid-portion 66 and extended portions 60 will be application specific and dependent on the load experienced in use. In the illustrated embodiment, the mid-portion 66 has between one third to two thirds the depth of the extended portions 60.

In order to provide suitable bonding area and structural support across the depth of the third and fourth panels 62, 64, the sidewalls 55 may extend inwardly for a predetermined distance. However, in areas of lower operating stress, some mass may be advantageously removed to reduce the weight of the dipper 28 whilst maintaining the required bonding strength from the structural adhesive. As such, in addition to the pivot and actuator mount apertures 57, 59, the side walls 55 may comprise a plurality of weight reducing apertures 67 which remove unnecessary mass to help reduce the weight of the dipper 28. In the illustrated embodiment, the mid-portion 66 includes elongate apertures 67 along the length thereof. The apertures 67 are positioned along the mid-depth line of the mid-portion 66 to provide a bonded section of approximately equal size on either side thereof. The bonded parallel tracks of sidewall created by the apertures may be connected by one or more bridges 68 as required.

In areas of higher operating stress, such as around the various mounting points of the pivots and actuators, the sidewalls 55 of the first and second panels 52, 54 may be unbroken so as to provide suitable structural support for the pivot bushings 65 and pivot pins etc.

As noted above, the third and fourth panels 62, 64 extend the full length of the upper and lower members 52, 54 and provide the external side wall surfaces of the dipper 28. The upper and lower edges of the third and fourth panels 62, 64 lie parallel to outermost surface of the base walls 53 and may be conterminous or slightly below respective outermost surface to help shield the end edge of the third and fourth panels 62, 64.

As will be appreciated, the dipper 28 will experience a stress profile in use with increased localized areas of stress, in particular at the first and second ends 34, 36 where the pivot and actuator mounts 31, 33, 42, 44, 49 are provided.

To help reduce stress induced failure, the pivot mounts 31, 33, 49 and actuator mounts 42, 44 may be provided with increased thickness when compared to the lower stress mid span regions. In the illustrated embodiment, the increased thicknesses are provided by additional reinforcement members 69, 84 located at or around the expected higher stressed regions.

Referring to FIG. 4, there are provided external reinforcement members 69 in the form of additional plates which extends around a peripheral edge 71 of the third and fourth panels 62, 64, predominantly around the arms 62', 64' and connect the cylinder mounts 42, 44 and boom pivot mount 31. Thus, there is shown an external plate which may be bonded on the external surface of the side panels 62, 64. A first end of the reinforcement member 69 comprises a bucket cylinder aperture 70. A bridging portion 73 extends to the dipper cylinder mount aperture 75 which comprises a second aperture for receiving the dipper cylinder pivot pin/bushing. A second peripheral bridging portion 77 extends from the dipper cylinder mount aperture 75 to the boom pivot mount 31 which includes a third aperture 79 for receiving the boom mount pivot pin or a corresponding bearing element. The second end of the external reinforcement member 69 terminates with a leg extension which runs from the third aperture 79 along an outer edge of the dipper 28. Thus, there is provided a reinforcing member 69 which extends serially between the bucket cylinder mount 44, the dipper cylinder mount 42 and the boom pivot mount 31. The bridging portions 73, 77 are generally elongate and may have a width which is less that the width of the aperture reinforcements.

It will be appreciated that the shape and dimensions of the reinforcement member 69 may be changed variously in accordance with a particular design and expected stress distribution. However, providing the reinforcement member 69 which extends between a plurality of pivot and/or actuator mounts with a single piece provides an efficient way to strengthen the structural member 28.

The internal side of the side panels 62, 64 may comprise respective reinforcement members 81 which broadly correspond to the external reinforcement members 69. Thus, there may be provided a reinforcing member 81 which extends serially between the bucket cylinder mount 44, the dipper cylinder mount 42 and the boom pivot mount 31. In the illustrated embodiment, the boom pivot mount 31 extends through external reinforcement member 69 and the main body 50 of the dipper 28 such that there is no requirement for a corresponding internal reinforcement member 81. As such, the internal reinforcement member 81 may terminate after the dipper cylinder mount 42 with a leg portion which extends to an end surface of the main body 50.

In some embodiments it may be preferable to provide additional reinforcement members in specific locations. Thus, as can be seen in FIG. 4, there are provided a second internal reinforcements 82 for the dipper cylinder mount 42 in the form of a linear plate member which extends from an aperture which surrounds the dipper cylinder mount 42 towards the end wall of the main body 50 where it terminates with a flange plate which is adhered to the end plate 88.

The second end 36 of the dipper 28 may comprise external third reinforcement members 84 which extend around and between the pivot mount connections 33, 49. Thus, there is shown a plate 84 having suitably sized apertures for receiving the bucket and tipping link pivot pins/bushings.

The reinforcement members 69, 81, 82, 84, may each be coterminous with the edge of the relative side member or underlying plate such that the edges are flush. Providing a flush edge in this way is not generally possible with welded plate construction due to the requirement of an external bead. However, providing a flush edged bonded plate allows the effectiveness of the reinforcement member to be maximized due to the increased thickness at the edge of the side member. A further advantage of using a bonded reinforcement member is that it allows the member to be larger than would be generally possible with a welded plate due to the size of the required weld.

The terminal ends of the main body 50 may comprise open ends. In order to close the open ends, there are provided one or more end plate 86, 88 which extend between the first, second, third and/or fourth panels 52, 54, 62, 64. In the illustrated embodiment there is provided a curved end plate 86 which extends around the bucket pivot mount bushing 65. The plate may be bonded to connecting pieces and/or to the first, second, third or fourth panels 52, 54, 62, 64. The first end 34 comprises a plurality of connecting pieces to which an end plate 88 is attached.

The end plates 86 and 88 combine to provide a closure which prevents the ingress of dirt and optionally water depending on the fit. The end plates 86, 89 will typically be non-structural and may comprise a low strength steel which is thinner than the structural panels 52, 54, 62, 64 of the main body 50. For example, the thickness of the end plates 86, 89 may be approximately 2-3 mm, whereas the structural panels 52, 54, 62, 64, may have a thickness ranged between 4 mm and 10 mm.

Figure 3:
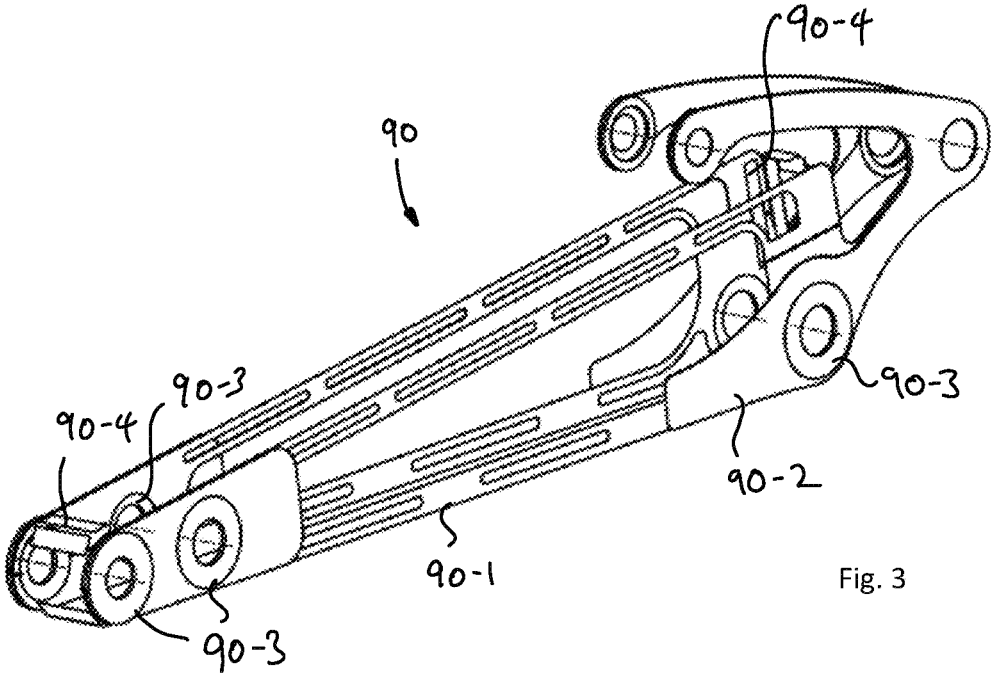
FIG. 3 shows an adhesive pattern used in the construction of the dipper of FIG. 2.

Referring to FIG. 3, there is provided the adhesive layers 90 which sit between and bond the various structural panels 52, 54, 62, 64, reinforcement members 69, 82, 84, and end plates 86, 88 of the dipper 28. The layers 90 are shown in a stacked configuration including the separate layers between the sidewalls 55 and side panels 62, 64, (layer 90-1) the side panels 62, 64 and the reinforcement members 69, 84, (layer 90-2) and the reinforcement members 69, 84 and bearing elements (layer 90-3).

The adhesive for each layer is applied across the full extent of the opposing surfaces which are being bonded. Hence, as can be seen, the adhesive layer 90-1 between the side walls 55 and the side panels 62, 64 may be applied across the full extent of the sidewalls 55. Thus, the shape shown in FIG. 3 corresponds directly to the side walls 55 and includes the extended portions at the first and second ends 34, 36 with the apertures and the mid-portion 66 comprising the apertures 57', 57". The end edges 61 at the interface between the opposing sidewalls 55 may also be bonded. Similarly, the adhesive layer 90-2 which bonds the reinforcing members 69, 84 may extend across the full extent of the interface. The full surface coverage may apply to all bonded components. Also shown are the adhesive strips 90-4 used to secure the end cap arrangements 86 and 88.

Figure 5:
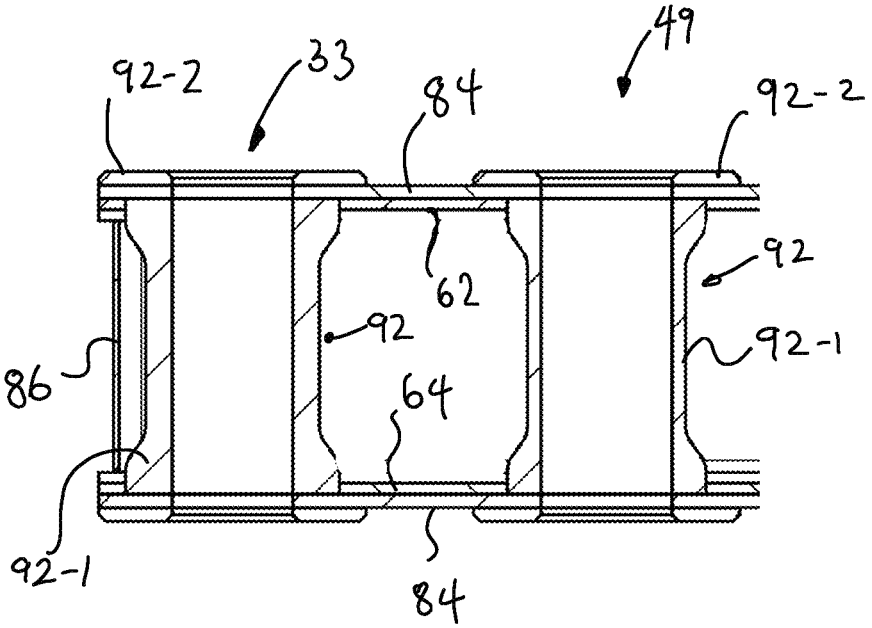
FIG. 5 shows a partial section of the dipper of FIG. 2.

FIG. 5 shows a partial section of the dipper 28 to show the internal construction of the pivot mounts 33, 49 for the bucket 30 and tipping link 38. Each of the bucket 30 and tipping link 38 pivot mounts comprise a bearing element 92 having a central element 92-1 and outer elements 92-2. The central element 92-1 may comprise a cylindrical bushing which extends between the side walls of the first and second panels 52, 54. The cylindrical bushings are received within the apertures 57 in the side panels 62, 64 with a compression fit to help prevent relative movement in use. The terminal ends of the cylindrical bushing may be conterminous, i.e. flush, with the outer surface of the side walls and capped with the reinforcement member 84.

The outer bearing element 90-2 comprises a planar bearing which may be referred to as a shim bearing or washer bearing which is located on the exterior of the dipper 28 so as to be between the side panel 62, 64 and the supported pivoting member, i.e. the bucket 30 or tipping link 38 (not shown in FIG. 5). The outer bearing element 90-2 may be bonded to the outermost external surface of the reinforcement member 84.

In the illustrated embodiment the outer 90-2 and central 90-1 bearing elements are discrete parts and not directly connected. However, in some embodiments, the central and outer bearing elements 90-1, 90-2 may be provided by a common part, e.g. a flanged bushing. In some embodiments, the bushing may be formed from two halves which are inserted through the apertures on either side and joined in the center.

Figure 6:
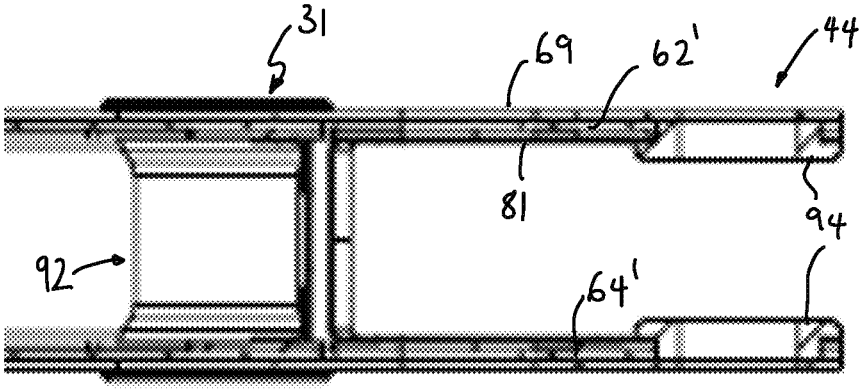
FIG. 6 shows a further partial section of the dipper of FIG. 2.

FIG. 6 shows a section through the bucket cylinder mount 44. The bucket cylinder mount 44 comprises flanged bushings 94 arranged in an opposing relation so as to provide axial and rotational support between the arms 60. The flanged bushings 94 may be bonded to the internal reinforcing members and/or the arms 62', 64'. The actuator mount 42 may be the same as actuator mount 44.

The materials used to make the working arm member 28 may comprise conventional steels with each of the panels comprising the same steel, as is the case for welded plate constructions. However, the use of adhesive to attach the panels 52, 54, 62, 64 allows different steels to be used. In a conventional welded plate construction, the limiting factor of the plate steel in terms of fatigue and failure will typically be the weld line with the steel due to known weaknesses. Thus, where steels of differing strengths are used in conjunction with each other, it is the weld to the lower strength steel which will provide the limit in terms of strength. As such, the use of different strengths of steel is limited in conventional plate welded constructions.

The use of a structural adhesives to bond the main structural components of the working arm member 28 allow for higher strength steels to be used in higher stress locations. In the illustrated example, the side members 62, 64 which carry the pivot mounts and actuator mounts, may be provided with a higher strength steel. In using a higher strength steel it is possible for the thickness of the plate to be reduced and the weight of the working arm to be similarly reduced. This can provide an efficiency benefit for the machine and help reduce the overall weight of the working machine 10 which may be advantageous, particularly for trailer towable machines.

The steels used may have yield strength between 240 MPa and 1200 MPa for example. The first, higher strength, steel may comprise a yield strength which is greater than approximately 670 MPa. The tensile strength of the higher grade steel may be between 770 and 940 MPa, for example. The second, lower strength, steel may have a yield strength which is greater than approximately 275 MPa, preferably greater than 345 MPa. The tensile strength of the lower grade steel may be between 470 MPa and 630 MPa.

In the illustrated example, the side members 62, 64 may comprise a first steel having a first type and strength characteristic. The steel may be, for example, a high strength steel such as E690. The first and second panels 52, 54 may comprise a second steel having a second type and strength characteristic. The second steel may be, for example, a lower strength steel such as S355. Other examples of steel will be well-known to the skilled person.

The thickness of the side members 62, 64 and the first and second panels 52, 54 may be comparable due to the difference in steel strength. Hence, in the illustrated example, the first and second panels 52, 54 and side members 62, 64 may have a thickness in the range of 3-5 mm. In an equivalent welded plate member with similar steels used for all of the panels, the pivot and actuator mount carrying members may have up to or above twice the thickness of the first and second panels.

In order to manufacture the structural member, the first, second, third and fourth panels 52, 54, 62, 64 may be cut and shaped prior to being cleaned and assembled as required. Shaping may involve pressing into the u-shaped channels for example. The cleaning may comprise any suitable mechanical or chemical clean such as grit blasting as well known in the art. A chemical clean may comprise a detergent or solvent based clean, or some combination thereof.

The application of the adhesive may vary according to type of adhesive. Generally, it will be necessary to control the thickness of the adhesive layer by using known techniques such as shims which are placed at required locations or glass balls within the adhesive. The thickness of the adhesive may be controlled to be approximately 0.2 mm thick to provide an optimum bond. The bonded structure may be subjected to a heat treatment process to aid or accelerate curing.

The one or more embodiments are described above by way of example only and variations are possible without departing from the scope of protection afforded by the appended claims.

The invention claimed is:

1. A working arm member of a working machine, comprising:

a first end and a second end having an elongate body extending therebetween, the body comprising:

first and second opposing panels; and third and fourth opposing panels, the third panel extending between a first edge of the first and second panels and the fourth panel extending between a second edge of the first and second panels to provide a box section;

the third and fourth panels comprising:

at least one pivot mount for connecting the working arm member to a further working arm member or the working machine; and, at least one actuator mount for connecting a working actuator, the working actuator being operable to move the working arm member, wherein the first, second, third and fourth panels are structurally bonded together by an adhesive, and wherein the first panel and second panel each comprise a unitary plate arranged as a U-channel having a base wall and side walls extending therefrom, the first and second panels opposing one another such that the base walls provide opposing external walls of the box section and the side walls extend towards one another to provide the respective first and second edges between which the third and fourth panels extend.

2. The member of claim 1, wherein the side walls extend for the full length of the first and second panels and the third and fourth panels are bonded along the full length of the side walls.

3. The member of claim 2, wherein the third and fourth panels comprise at least one aperture for receiving the pivot pin of a pivot mount or actuator mount, and wherein the member comprises a first aperture at a first end and a second aperture at a second end of the first and second panels.

4. The member of claim 1, wherein the side walls of the first and second panels contact one another at an interface at the first end and/or second end, wherein the interface is bonded.

5. The member of claim 4, wherein the interface is provided by an end edge of an extended portion of the side walls.

6. The member of claim 5, comprising extended portions at the first end and second end of the first and second panels, the side walls having a mid-portion extending longitudinally therebetween, wherein the depth of the mid-portion is less than the depth of the extended portion.

7. The member of claim 6, wherein the mid-portion comprises elongate apertures along the length thereof.

8. The member of claim 3, wherein the side walls comprise at least one further aperture which corresponds to the at least one aperture.

9. The member of claim 8, wherein the further aperture is provided between the opposing side walls at the first end or second end.

10. The member of claim 1, wherein the third and fourth panels are longer than the first and second panels.

11. The member of claim 1, comprising at least one reinforcement member located around the at least one actuator mount and/or the at least one pivot mount.

12. The member of claim 11, further comprising a plurality of pivot mounts and actuator mounts, wherein the reinforcement member comprises a plate which extends between the plurality of pivot mounts and actuator mounts, wherein there are at least three pivot and actuator mounts.

13. The member of claim 11, wherein the reinforcement member extends around a peripheral edge of the third and/or fourth panels.

14. The member of claim 13, wherein the reinforcement member is flush with the peripheral edge of the third and/or fourth panels.

15. A working arm member of a working machine, comprising:

a first end and a second end having an elongate body extending therebetween, the body comprising:

first and second opposing panels; and third and fourth opposing panels, the third panel extending between a first edge of the first and second panels and the fourth panel extending between a second edge of the first and second panels to provide a box section;

the third and fourth panels comprising:

at least one pivot mount for connecting the working arm member to a further working arm member or the working machine; and, at least one actuator mount for connecting a working actuator, the working actuator being operable to move the working arm member, wherein the first, second, third and fourth panels are structurally bonded together by an adhesive, and wherein the first and second panels comprise a first steel type having a first strength and the third and fourth panels comprise a second steel type having a second strength, wherein the second strength is greater than the first strength.

16. The member of claim 15, wherein the first, second, third and fourth panels have similar thicknesses.

17. The member of claim 1, wherein the member is a dipper of a working arm of an excavator.

18. The member of claim 1, wherein the side walls of the first and second panels comprise one or more weight reducing apertures, and wherein the apertures are elongate and extend along the length of the side walls.

19. A working machine, comprising:

a working arm member, the working arm member including:

a first end and a second end having an elongate body extending therebetween, the body comprising:

first and second opposing panels;

third and fourth opposing panels, the third panel extending between a first edge of the first and second panels and the fourth panel extending between a second edge of the first and second panels to provide a box section;

the third and fourth panels comprising:

at least one pivot mount for connecting the working arm member to a further working arm member or the working machine; and, at least one actuator mount for connecting a working actuator, the working actuator being operable to move the working arm member, wherein the first, second, third and fourth panels are structurally bonded together by an adhesive, and wherein the first panel and second panel each comprise a unitary plate arranged as a U-channel having a base wall and side walls extending therefrom, the first and second panels opposing one another such that the base walls provide opposing external walls of the box section and the side walls extend towards one another to provide the respective first and second edges between which the third and fourth panels extend.

* * * * *